US007862491B1

(12) United States Patent
Wang

(10) Patent No.: US 7,862,491 B1
(45) Date of Patent: Jan. 4, 2011

(54) RESISTANCE ARRANGEMENT OF A WAIST-TWISTING MACHINE

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 12/606,172

(22) Filed: Oct. 26, 2009

(51) Int. Cl.
*A63B 22/14* (2006.01)

(52) U.S. Cl. ..... 482/147; 482/80; 482/130

(58) Field of Classification Search ..... 482/51, 482/79–80, 146–147, 34, 142, 148, 139, 482/92, 121–130
See application file for complete search history.

(56) References Cited

U.S. PATENT DOCUMENTS 4,199,137 A * 4/1980 Giguere ..... 482/79
5,545,111 A * 8/1996 Wang et al. ..... 482/53
6,875,159 B2 * 4/2005 Chuang ..... 482/51
6,902,514 B2 * 6/2005 Chuang ..... 482/52
7,118,519 B2 * 10/2006 Slowinski ..... 482/146
7,614,990 B2 * 11/2009 Baek ..... 482/146
2005/0164849 A1 * 7/2005 Saikawa ..... 482/92
2007/0027001 A1 * 2/2007 Alessandri et al. ..... 482/51

* cited by examiner

*Primary Examiner*—Lori Baker

(57) ABSTRACT

A resistance arrangement of a waist-twisting machine, wherein the waist-twisting machine having a bottom base, a foot-rotating disc, and a handrail frame. The operation of the foot-rotating disc imparts a motion to a lateral post coupled with the handrail frame such that the hands and the feet rotate in opposite direction. Two driven arms are pivotally attached to the bottom base, and a plurality of elastic elements are interposed between the driven arms. Moreover, a bumping post is positioned between the driven arms for limiting the driven arms to a proper return position. One of the driven arms corresponding to the exercise direction will be extended outwards by a contact roller at the bottom of the lateral post when the lateral post is moved by an external force. At that time, another driven arm that is not moved will stay there to act as a fixing end. Accordingly, the elastic elements may be pulled to produce an expected exercise resistance.

1 Claim, 7 Drawing Sheets

RESISTANCE ARRANGEMENT OF A WAIST-TWISTING MACHINE

BACKGROUND OF THE INVENTION

1. Fields of the Invention

The invention relates to a resistance arrangement of a waist-twisting machine, and more particularly, to a structure that achieves an excellent exercise resistance effect and ensures a prolonged service life of the elastic elements.

2. Description of the Related Art

As we all know, the so-called "waist twist machine" is a fitness device by which the user may twist his waist and his abdominal muscles to achieve the unique exercise effect. At present, the conventional similar devices almost employ a rotating disc as a structural basis on which a user stands to apply force for its rotation. In use, the user has to hold a fixed handle with his both hands so that his upper body is positioned at a certain angle. At this point, the user twists the lower part of his body to the left and right side. In this way, the fitness exercise of the waist and the abdominal part is achieved.

The above-mentioned fitness device can be easily operated. Moreover, there is no special mechanical design. In taking the exercise effect into account, we find that the rotating disc does not provide a resisting force against the rotation thereof. Therefore, it is not possible for the operator to apply another force for increasing the exercise effect. Thus, the conventional device requires further improvements.

SUMMARY OF THE INVENTION

An object of the invention is to provide a resistance arrangement of a waist-twisting machine that includes a resistance apparatus for providing an exercise resistance, such that the operator can apply another force to overcome the resistance. In this way, an expected effect in improving his health and training his muscles may be achieved.

According to the invention, two driven arms are pivotally attached to the bottom base, and a plurality of elastic elements are interposed between the driven arms. Moreover, a bumping post is positioned between the driven arms for limiting the driven arms to a proper return position. One of the driven arms corresponding to the exercise direction will be extended outwards by a contact roller at the bottom of the lateral post when the lateral post is moved by an external force. At that time, another driven arm that is not moved will stay there to act as a fixing end. Accordingly, the elastic elements may be pulled to produce an expected exercise resistance.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
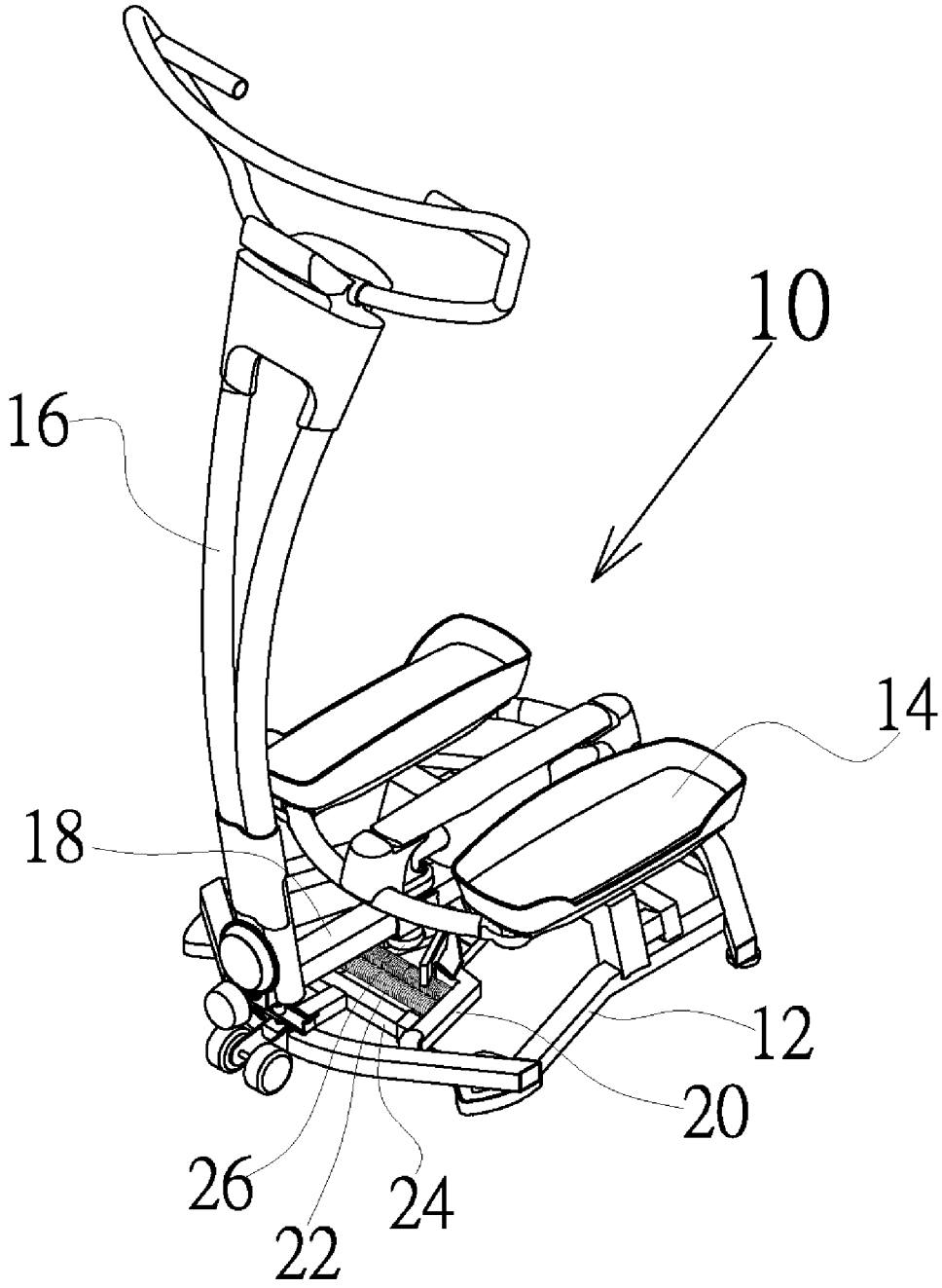
FIG. 1 is a perspective view of a preferred embodiment of the invention.
Figure 2:
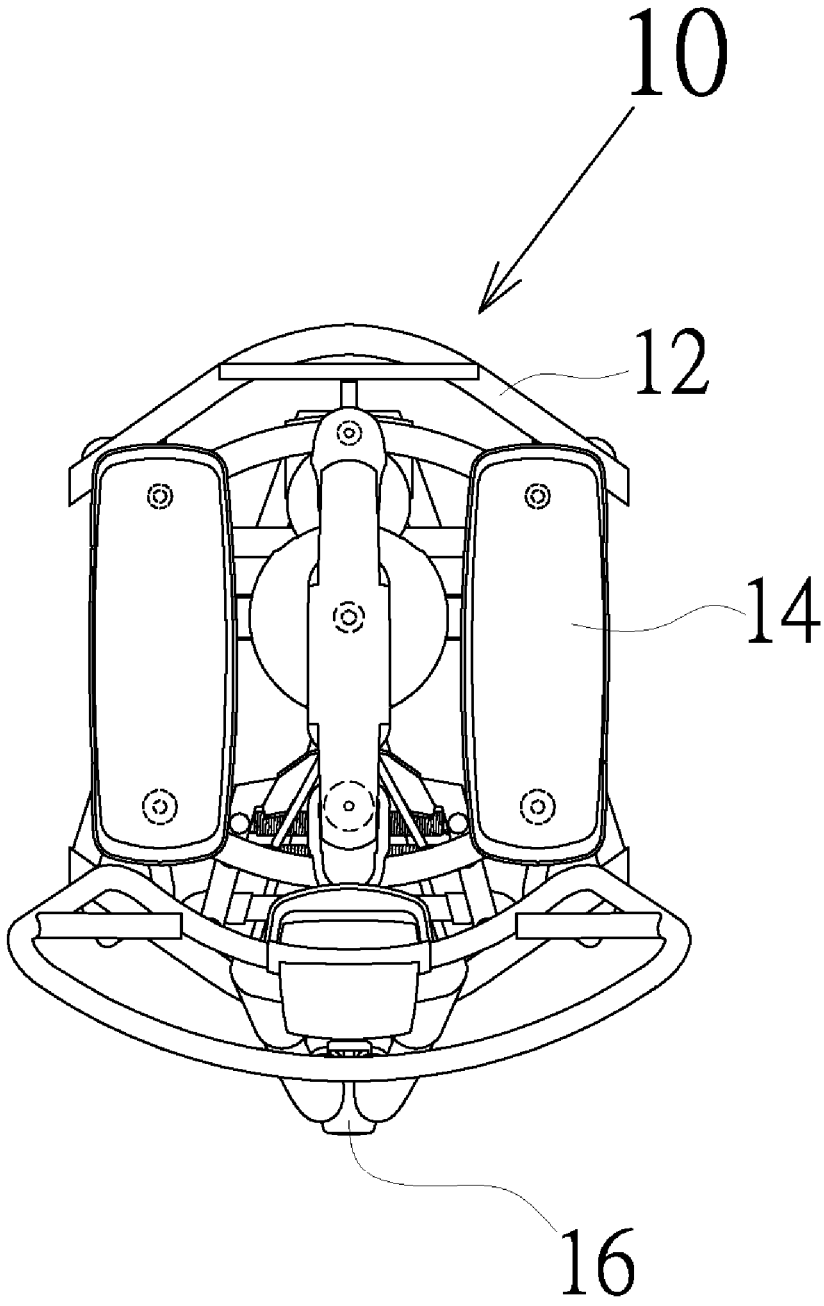
FIG. 2 is a top view of the preferred embodiment of the invention according to FIG. 1.
Figure 3:
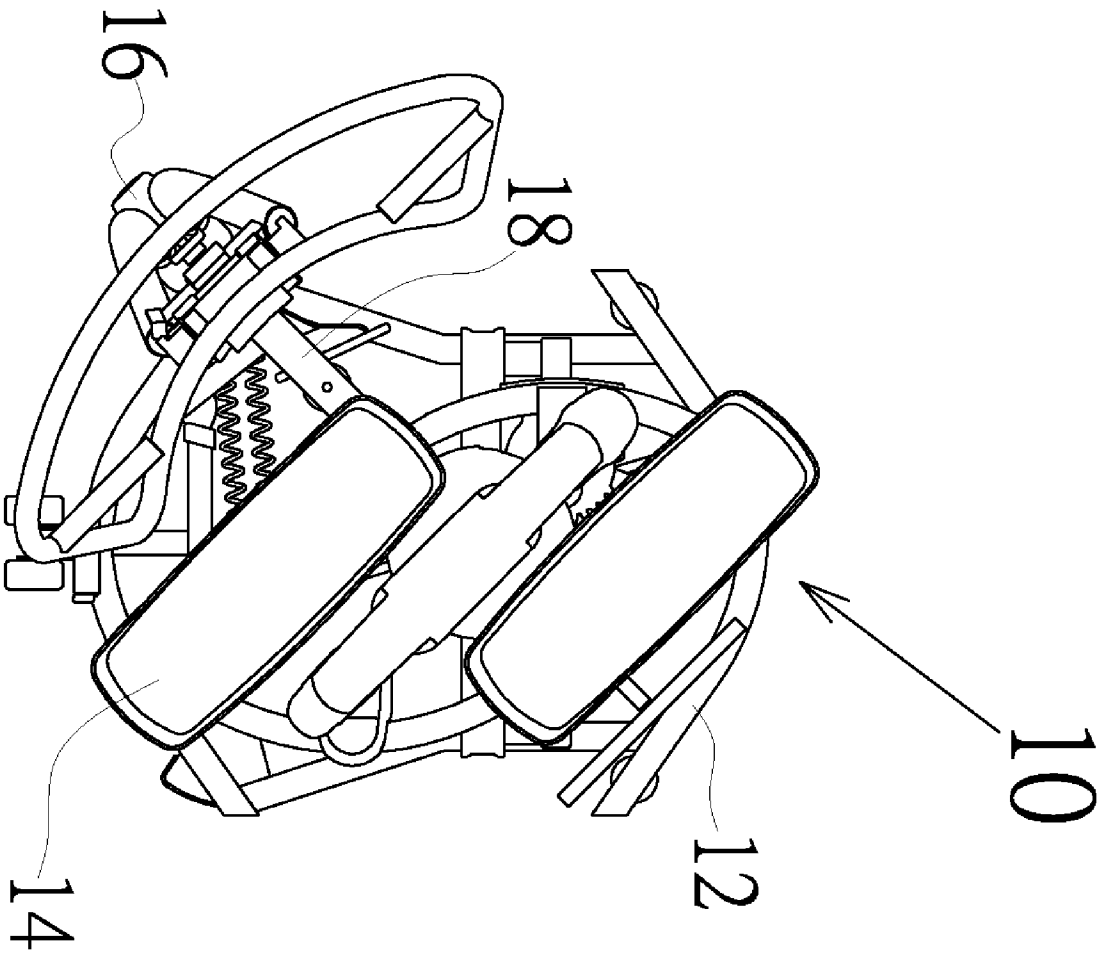
FIG. 3 is a schematic drawing of the preferred embodiment of the invention according to FIG. 2 wherein the operation and its movement direction are illustrated.
Figure 4:
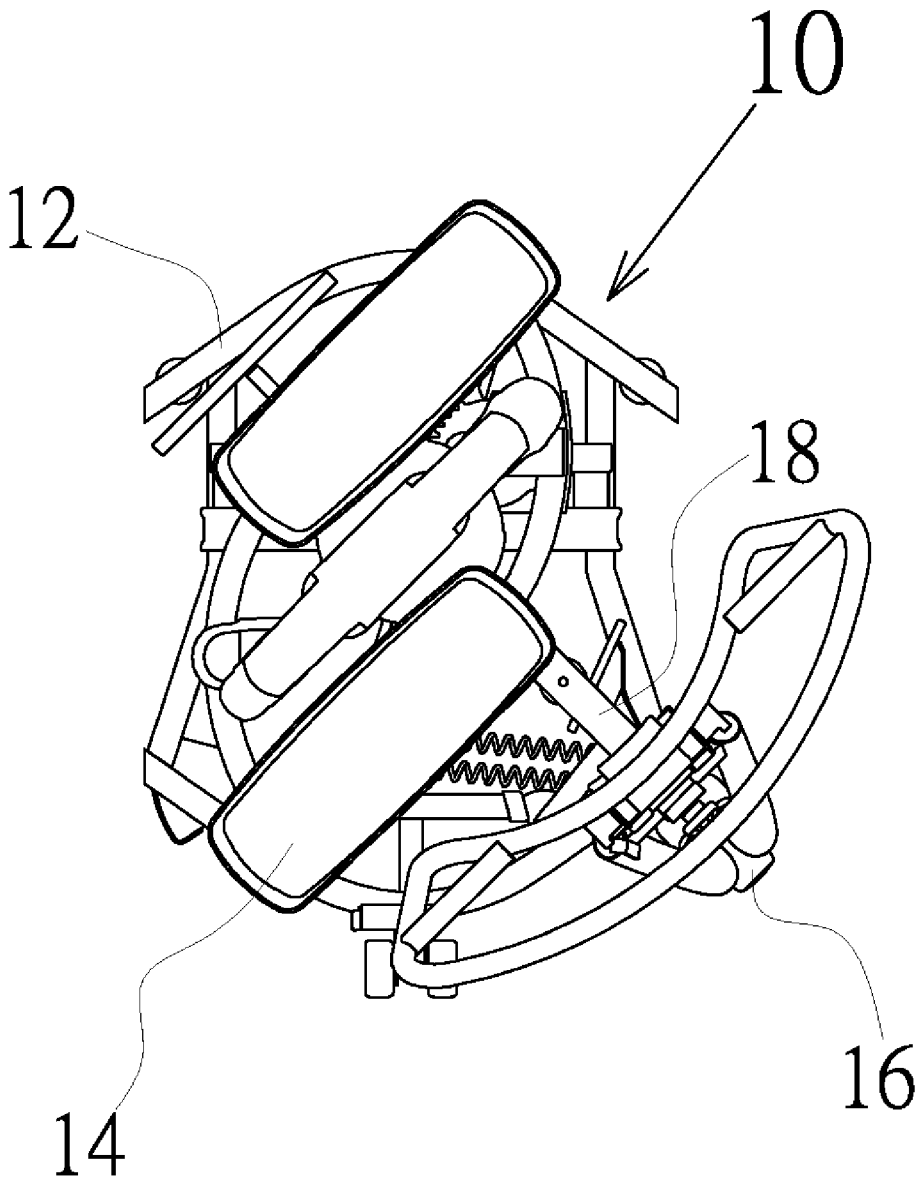
FIG. 4 is a schematic drawing of the preferred embodiment of the invention according to FIG. 1 wherein another operation and its movement direction are illustrated.

The present invention will now be described in more detail hereinafter with reference to the accompanying drawings that show a preferred embodiment of the invention.

A basic and continuous operation process of the invention is illustrated In FIGS. 1 through 4. It is apparent from the drawing that the waist-twisting machine 10 includes a bottom base 12, a foot-rotating disc 14, and a handrail frame 16. The operation of the foot-rotating disc 14 imparts a motion to a lateral post 18 coupled with the handrail frame 16 such that the hands and the feet rotate in opposite direction.

Figure 5:
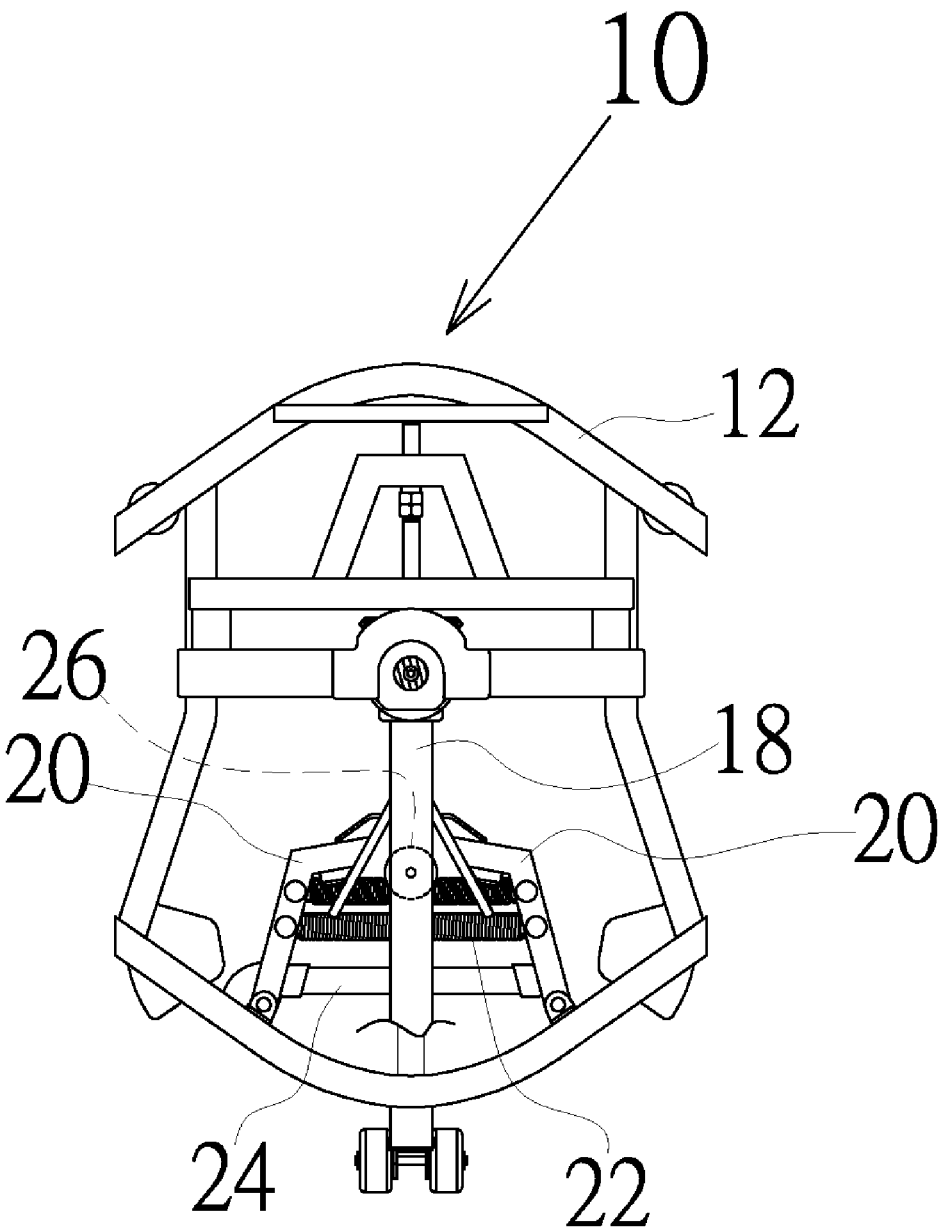
FIG. 5 is a schematic drawing of the partial structure according to FIG. 2.
Figure 6:
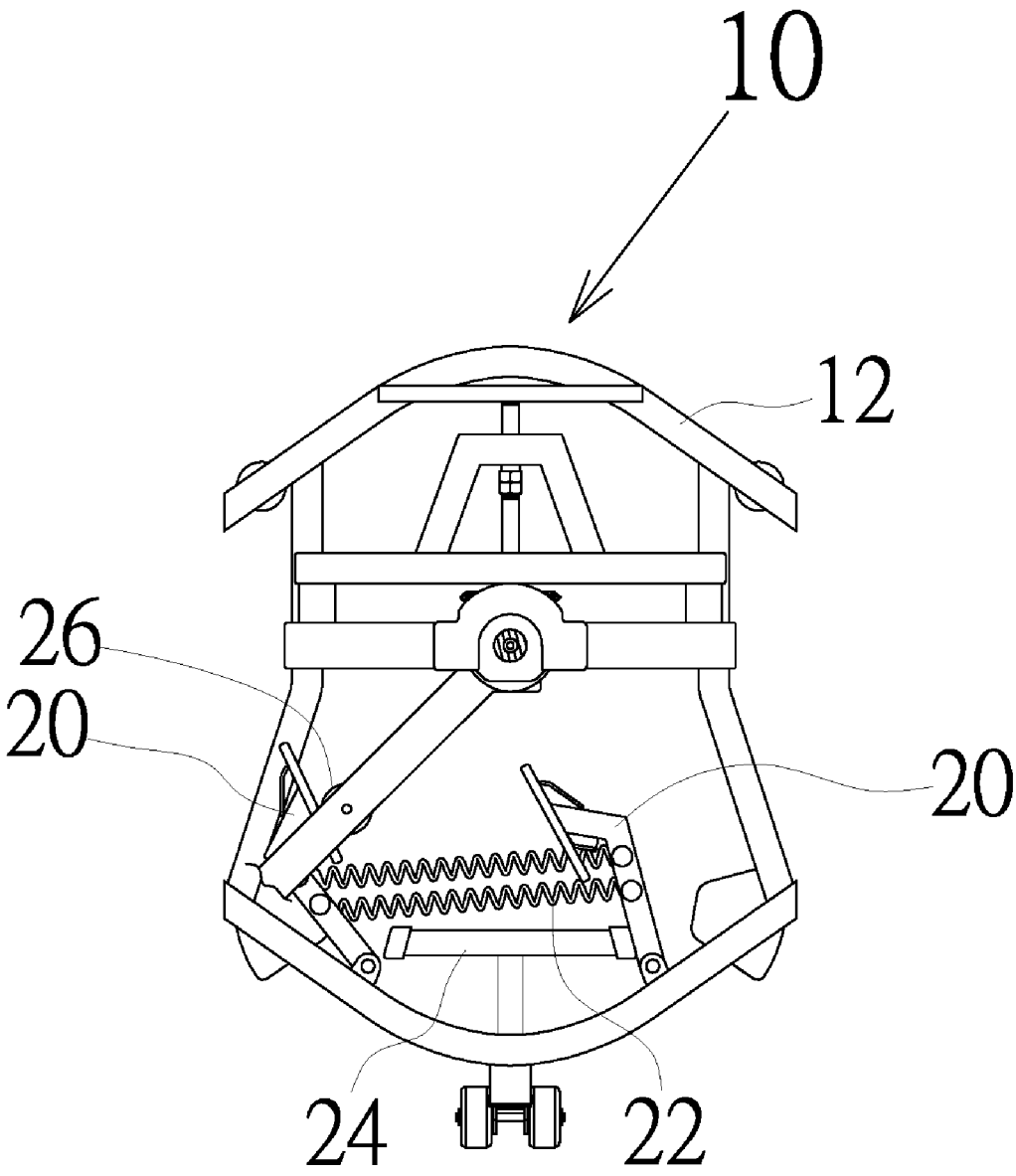
FIG. 6 is a schematic drawing of the operation of the structure according to FIG. 5.
Figure 7:
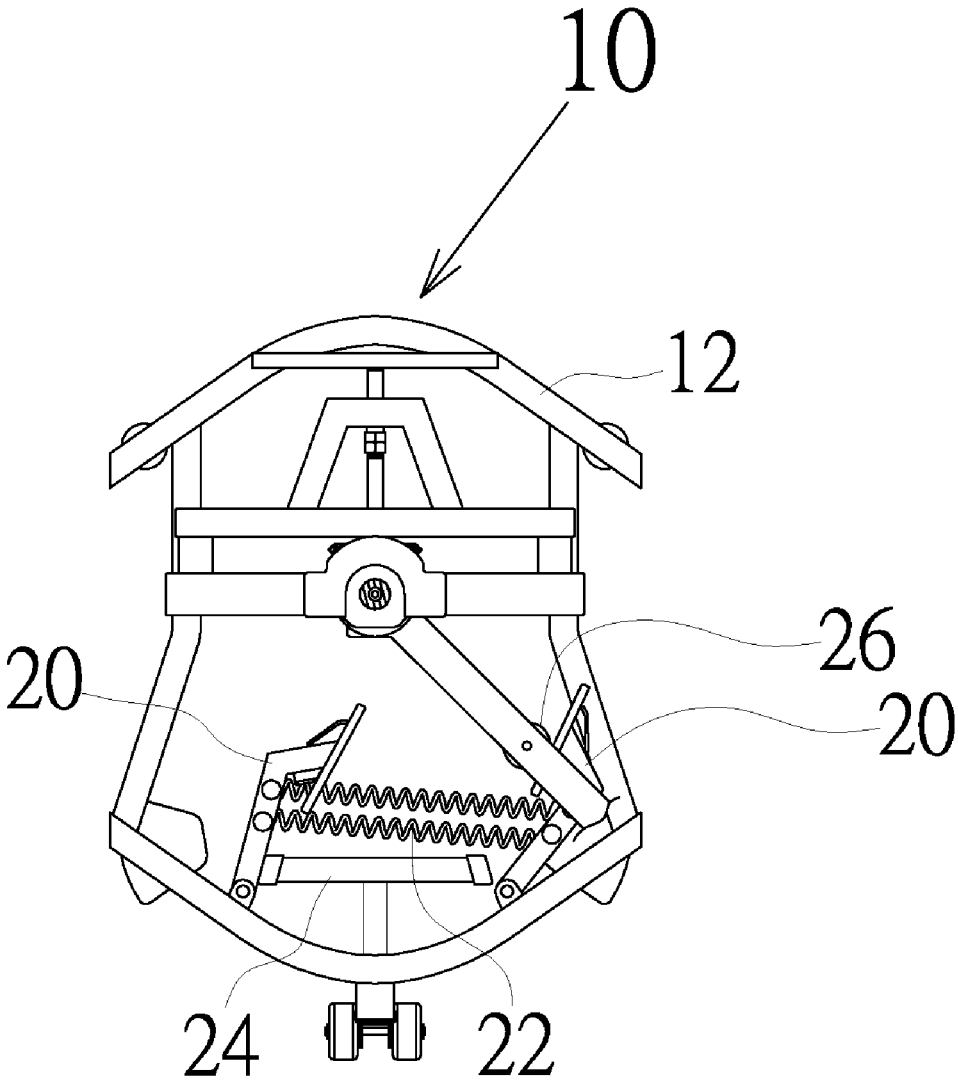
FIG. 7 is a schematic drawing of another operation of the structure according to FIG. 5.

Then, please refer to FIGS. 5 through 7. In order to facilitate the illustration of the components, the foot-rotating disc 14 and the handrail frame 16 are not included in FIGS. 5 through 7. Two driven arms 20 are pivotally attached to the bottom base 12. A plurality of elastic elements 22 are interposed between the driven arms 20. Moreover, a bumping post 24 is positioned between the driven arms 20 for limiting the driven arms 20 to a proper return position. One of the driven arms 20 corresponding to the exercise direction will be extended outwards by a contact roller 26 at the bottom of the lateral post 18 when the lateral post 18 is moved by an external force. At that time, another driven arm 20 that is not moved will stay there to act as a fixing portion. In this way, the elastic elements 22 may be pulled to produce an expected exercise resistance.

When the external force is removed or the operator applies a force in an opposite direction, the lateral post 18 will be returned to the middle position (see FIG. 5) by the resilience of the elastic elements 22. At that time, the driven arms 20 previously moved will be limited by the bumping post 24. Thereafter, the driven arm 20 at the opposite end creates an exercise resistance at the opposite direction by means of the contact roller 26.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A resistance arrangement of a waist-twisting machine comprising:

a bottom base, a foot-rotating disc rotatable about a first vertical axis, a handrail frame, a lateral post rotatable about the first vertical axis and coupling the foot-rotating disc and the handrail frame such that operation of the foot-rotating disc imparts a motion to the lateral post such that the foot-rotating disc and the handrail frame rotate in opposite direction about the first vertical axis, a contact roller arranged at a bottom surface of the lateral post, two driven arms pivotally attached to the bottom base, a plurality of elastic elements interposed between the driven arms; and a bumping post positioned between the driven arms so as to limit the driven arms to a return position;

wherein one of the driven arms corresponding to a first exercise direction is extended outwards by the contact roller when the lateral post is moved and wherein the other driven arm, remains fixed in place such that the elastic elements are pulled to produce an exercise resistance and to exert a return force on the lateral post towards a middle position.

* * * * *